United States Patent [19]

Mahood

[11] 4,414,761

[45] Nov. 15, 1983

[54] FOOTWEAR ARTICLE WITH ADJUSTABLE CLOSURE

[76] Inventor: Douglas S. Mahood, 48 Glen Watford Dr., Agincourt, Ontario, Canada, M1S 2C3

[21] Appl. No.: 317,375

[22] Filed: Nov. 2, 1981

[51] Int. Cl.[3] ..... A43B 11/00; A43C 1/00

[52] U.S. Cl. ..... 36/50; 24/140

[58] Field of Search ..... 36/50, 51, 114, 129, 36/136; 2/DIG. 6; 24/204, 140, 117

[56] References Cited

U.S. PATENT DOCUMENTS

| | | | |
|---|---|---|---|
| 1,346,019 | 7/1920 | Haag | 36/50 |
| 3,279,015 | 10/1966 | Henning | 24/140 X |
| 3,626,610 | 12/1971 | Dassler | 36/50 |
| 4,081,916 | 4/1978 | Salisbury | 36/50 |
| 4,114,297 | 9/1978 | Famolare, Jr. | 36/50 |
| 4,308,672 | 1/1982 | Antonious | 36/50 |

FOREIGN PATENT DOCUMENTS

| | | | |
|---|---|---|---|
| 648959 | 8/1937 | Fed. Rep. of Germany | 24/140 |
| 2271782 | 12/1975 | France | 24/204 |
| 288705 | 6/1953 | Switzerland | 36/50 |

*Primary Examiner*—James Kee Chi

*Attorney, Agent, or Firm*—Sim & McBurney

[57] ABSTRACT

A footwear article such as an athletic shoe is disclosed. The article has a closure which in a preferred embodiment takes the form of flap means incorporating a lace. The flap means is secured at one end to the upper and extends across an access opening down the front of the shoe and can be releasably fastened to the upper adjacent its distal end by VELCRO (TM) fabrics secured between the underside of the flap and the upper.

7 Claims, 5 Drawing Figures

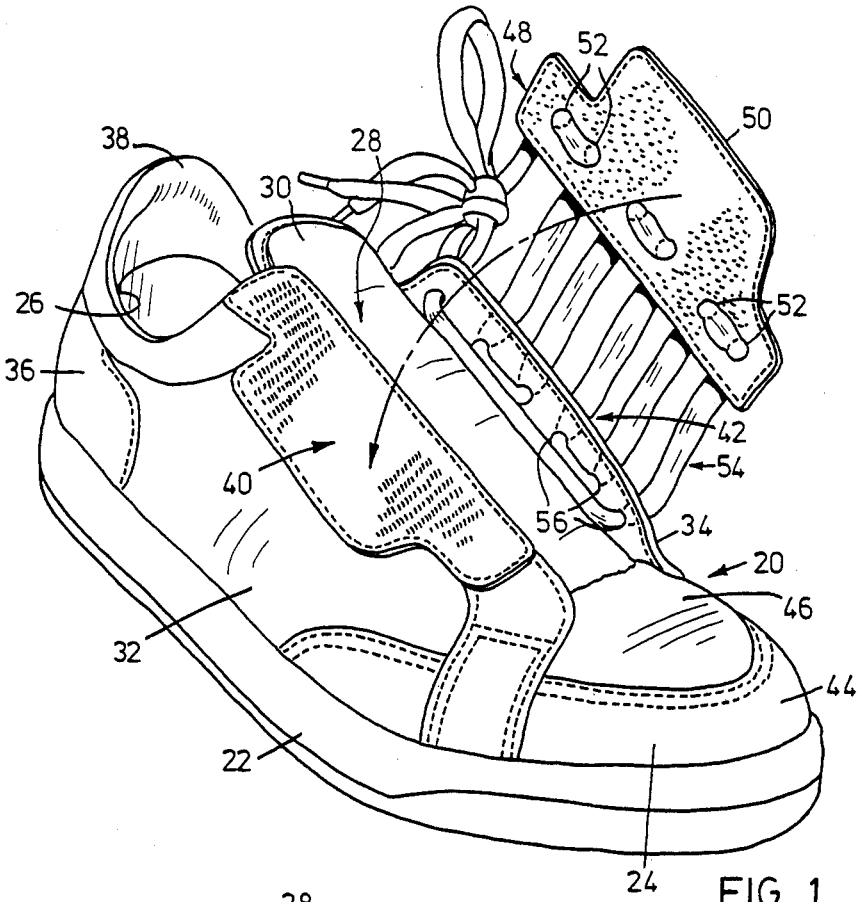
FIG. 1
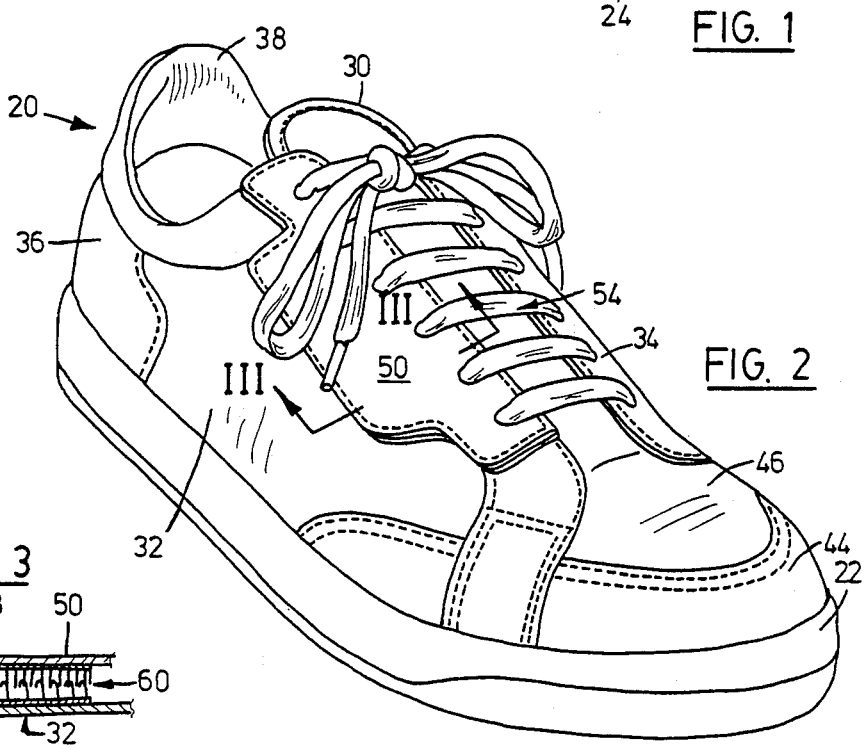
FIG. 2
FIG. 3
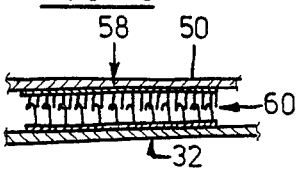

FOOTWEAR ARTICLE WITH ADJUSTABLE CLOSURE

This invention relates generally to footwear articles and is concerned more particularly with a footwear article having an improved closure.

The invention has been devised primarily in the environment of athletic shoes (but is not limited to this type of shoe). Typically, an athletic shoe has a lace-type closure and while this form of closure works well in practice, some inconvenience is associated with the manipulation of the closure. For example, many athletic shoes extend relatively far up the instep of the wearer's foot for improved fit and consequently must have relatively long eye stays (lacing strips). When a shoe of this type is to be taken off, the laces must be over a relatively long distance along the eye stays. Conversely, when the shoe is put on, the laces must be tightened all along the eye stays if a proper fit is to be achieved.

Nowadays, it is common for children to wear athletic shoes almost exclusively. However, children often lack the patience required to repeatedly unlace and relace the shoes in the proper manner. Sometimes, there may even be a tendency to leave the shoes permanently laced and treat them as "slip on" shoes, forcing the shoe off the foot without untying the laces and forcing the foot into the already laced shoe. Inevitably, this leads to structural damage to the shoe; usually, the heel portion of the upper (the counter) is broken down.

The following Canadian patents disclose examples of prior art closures for footwear articles:

U.S. Pat. No. 475,071—(Hunt)

U.S. Pat. No. 853,417—(Gleisner)

U.S. Pat. No. 935,640—(Lupien et al.)

An object of the present invention is to provide a footwear article having an improved closure.

According to the invention, the footwear article includes a sole and an upper which defines a space above the sole for receiving a wearer's foot. The upper includes an ankle opening and an access opening which extends from the ankle opening towards the toe area of the article and which is arranged to permit portions of the upper adjacent the access opening to be raised to facilitate movement of the wearer's foot into and from the space. A closure is provided for the access opening, the closure comprising flap means having a first portion secured to the upper adjacent the first side of the access opening. The flap means extends across the opening and has a second portion adapted to be releasably secured to the upper adjacent a second side of the access opening. Releasable fastening means are provided on the second portion and on the upper for securing the second portion. The second portion of the flap means is constituted by a flap member which has part thereof permanently affixed to the upper, whereby alignment of the flap member on the upper is readily accomplished.

In one embodiment, the fastening elements may comprise male and female elements of a "press stud" type of fastener and in another embodiment, the fastener elements may be defined by parts of fabrics having cooperable formations which render the fabrics mutually cohesive. An example of fabrics of this type are those sold under the trade mark VELCRO.

In order that the invention may be more clearly understood, reference will now be made to the accompanying drawings which illustrate preferred embodiments of the invention by way of example, and in which:

FIGS. 1 and 2 are perspective views of a running shoe constructed in accordance with a first embodiment of the invention, the shoe being shown in FIG. 1 with its closure in the open position and in FIG. 2 with the closure in the closed position;

FIG. 3 is a schematic cross-sectional view generally along line III—III of FIG. 2 and shows the fastening elements used in the closure; and, FIGS. 4 and 5 are views corresponding to FIGS. 1 and 2 respectively showing a running shoe constructed according to a further embodiment of the invention.

Figure 4:
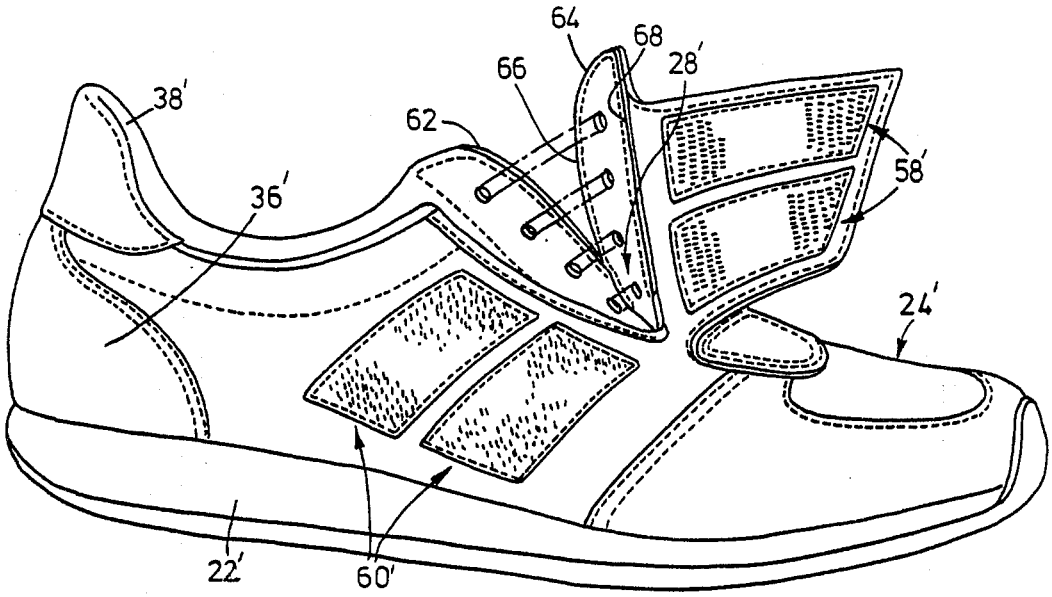

Referring first to FIGS. 1 and 2, a running shoe is generally denoted by reference numeral 20 and has a sole 22 and an upper 24 which defines a space above the sole for receiving a wearer's foot. The upper has an ankle opening 26 and an access opening generally denoted 28 which extends from the ankle opening 26 towards the toe area of the article as in a normal running shoe. The access opening 28 permits portions of the upper adjacent the opening to be raised or partly folded back to facilitate movement of wearer's foot into and from the space defined by the upper. A tongue is provided below the access opening and is indicated by reference numeral 30 and a closure is provided for the opening as will be more particularly described.

Apart from the closure, the shoe is essentially of conventional construction. Constructional details will not therefore be described. For present purposes, it is sufficient to note that the upper includes respective side portions 32 and 34 which extend rearwardly and join a heel portion or "quarter" 36. The usual padding is provided around the ankle opening 26 as indicated at 38. The side portions 32 and 34 are shaped to define elongate areas which extend along both sides of the access opening 28 and which are denoted by reference numerals 40 and 42. In a conventional shoe, these areas would form the eye stays or lacing strips of the shoe; in the present case, area 42 is provided with eyelets while area 40 is unapertured. As will be described in more detail later, area 40 is in fact provided with fastening elements forming part of the closure for the article.

Adjacent their forward (toe) ends, the side portions 32 and 34 are stitched to a toe cap portion 44 and to a vamp portion 46 above the toe cap portion. Tongue 30 is stitched to and extends upwardly and rearwardly from vamp 46. As indicated above, these constructional features of the shoe are essentially conventional.

The shoe closure includes flap means generally indicated by reference numeral 48 secured to the upper 24 adjacent a first side of the access opening 28, represented in this case by the elongate area 42 of the upper. The flap means is adapted to extend across access opening 28 and releasable fastening means are provided to secure a distal end portion of the flap means to the upper adjacent the opposite side of opening 28 as repesented by the upper area 40, for securing the footwear article about the foot of a wearer. In this particular embodiment, the flap means 48 is defined by a panel 50 which is provided with a series of lacing openings 52 in the manner of an eye stay, and a lace 54 which connects the panel to the eye stay provided by the elongate area 42 of upper 24. Openings 56 in eye stay 42 are arranged in positions corresponding to the positions of the openings 52 in panel 50 so that, when the flap means is in the closed position in which it is shown in FIG. 2, the lace 54 presents the appearance of a typical, conventional lacing arrangement for an athletic shoe. Panels 50 may be of any appropriate shape and in the illustrated embodiment is shaped to present a decorative appearance at the outer side of the shoe.

Panel 50 is secured in the "closed" position in which it is shown in FIG. 2 by VELCRO (TM) fabrics secured respectively to the opposed surface portions of panels 50 and the elongate area of upper 24. FIG. 3 is a diagrammatic sectional view through panel 50 and the underlying portion of upper 24 and the respective fabrics are generally denoted by reference numerals 58 and 60. It is well known that VELCRO fabrics comprise a first fabric having a surface covered with fine forming a nap on the fabric and a second fabric having a surface covered with fine hooks which engage with the fibres for securing the fabrics together. In FIG. 3, these fabrics are generally denoted by the reference numerals 58 and 60 respectively. It will of course be appreciated that the positions of the respective fabrics could be reversed with fabric 60 on flap 50 and fabric 58 on the upper. The fibres of fabric 58 define fastening elements which interengage with the corresponding fastening elements of fabric 60 (the hooks) for securing panel 50 in position. At the same time, the panel can be detatched from the upper by pulling upwardly on the panel so that the hooks and fibres of the respective fabrics pull apart, allowing the panel to be raised to open the shoe closure. The fastening elements (fibres and hooks) of the VELCRO (TM) fabrics effectively cover the surfaces of the respective fabrics so that panel 50 can be positioned in any of a plurality of fastening positions in which the flap means of the closure embraces the foot of the wearer to a lesser or a greater extent. This allows the flap means to be adjusted to provide for optimum comfort and security of fit.

To summarize, the closure provided for the shoe shown in FIGS. 1 and 2 of the drawings has the advantage that it can be readily opened and closed and that the tightness of the closure can be adjusted without the need to adjust the lace 54. To take off the shoe, it is merely necessary to grasp and lift panel 50 so as to rear apart the VELCRO fabrics 58 and 60. Conversely, after the foot has been inserted into the shoe, the closure can be fastened by merely folding down the flap means and repositioning panel 50 in the area 40 of the upper at a position providing the required tightness of fastening of the closure.

Figure 5:
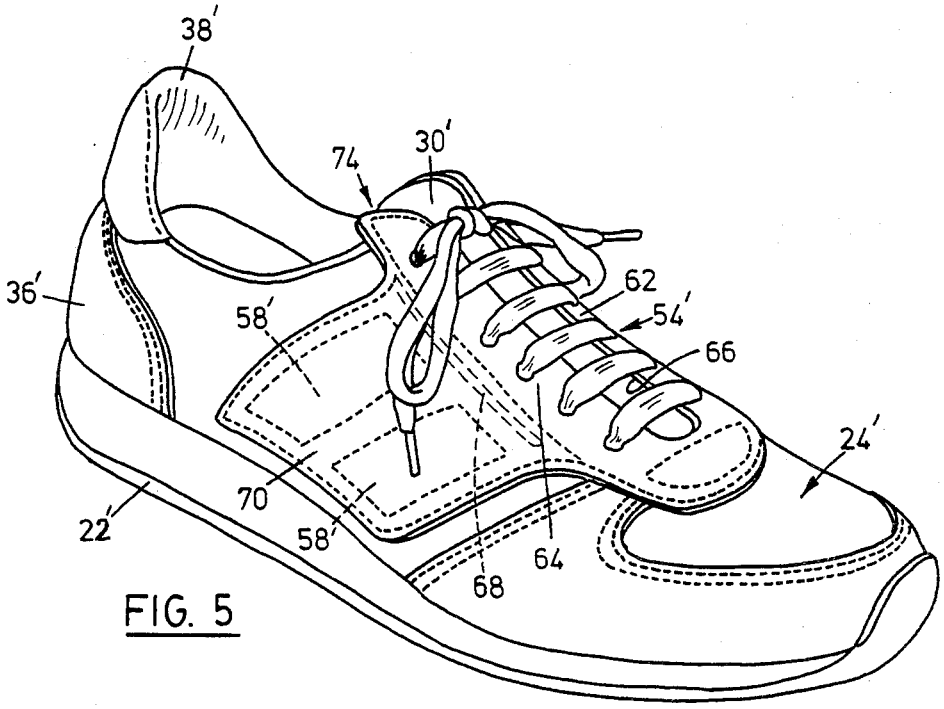

FIGS. 4 and 5 illustrate an alternative embodiment of the invention in which primed reference numerals have been used to denote parts of the shoe which correspond with parts shown in FIGS. 1 and 2. In the embodiment of FIGS. 4 and 5, the shoe has a sole 22' and an upper 24'. The upper is of somewhat different design from the upper 24 shown in FIGS. 1 and 2 but essentially has the same principal components. FIG. 5 shows the closure of the shoe in the closed position while FIG. 4 shows the closure open. In FIG. 4, the lace 54' has been shown in chain dotted outline only and the tongue 30' (FIG. 5) has been omitted for clarity of illustration.

In this embodiment, the shoe upper has a pair of eye stays 62 and 64 separated by an elongate opening 66, as in a conventional athletic shoe. However, in this case, the access opening 28' which permits the shoe to be put on and taken off is effectively defined by a slit 68 which extends through the upper generally parallel to and outwardly of eye stay 64. The flap means of the shoe in this case takes the form of a flap 70 which extends laterally outwardly from eye stay 64 so as to extend across the access opening 28' defined by slit 68.

In FIG. 4, flap 70 is shown folded back (along with eye stay 64) to expose the slit 68. Accordingly, the edges which define slit 68 are shown spaced relatively widely and defining a relatively wide V shape. In fact, the side edges of the slit extend substantially parallel to one another when the closure is in the normal, closed position in which it is shown in FIG. 5. The slit is in fact indicated in dotted lines in FIG. 5 below flap 70 and appears as a parallel sided slit.

VELCRO (TM) fabrics are provided on the underside of flap 70 and on the corresponding opposed portion of upper 24'. These fabrics are generally denoted by reference numerals 58' and 60' respectively; in fact, each fabric is in the form of two generally rectangular strips stitched to the relevant portion of the upper. The strips on the side of the shoe are angled forwardly and upwardly and the strips on flap 70 are correspondingly positioned so as to tend to resist forward motion of the foot within the shoe such as might cause the closure to be loosened or detached, for example by movement of flap 70 with respect to the VELCRO material 60'.

FIG. 5 shows the closure in its closed position and it will be seen that flap 70 is in fact part of a piece of fabric which also includes a U-shaped portion which forms the eye stays 62 and 64. This piece of fabric is generally denoted 74 and is stitched to the upper of the shoe so as to leave flap 70 free. Lines of stitching secure this piece of fabric in place, the fabric being effectively secured to the upper along substantially the entire extent of the outer edge of the eye stay 62, to a point just below slit 68. As a result, flap 70 can be raised and the closure of the shoe opened without causing any substantial disburbance of the lace 54'. To this extent, the embodiment shown in FIGS. 4 and 5 may be considered to be preferred as compared with the embodiment of FIGS. 1 and 2 in which panel 50 is free of permanent attachment to the shoe upper.

It will of course be appreciated that the preceding description relates to specific embodiments of the invention only and that many modifications are possible within the broad scope of the invention. For example, it would be possible to secure panel 50 to the upper adjacent the lower edge of the panel (i.e. the edge nearest the toe of the shoe); in this way, the panel 50 would remain attached to the upper, thereby minimizing disburbance to the laces when the closure is opened. Another possibility would be to dispense with a lace and attach directly to the upper a flap of sufficient length to extend across the access opening and be attached to the upper at the opposite side of the opening. For example, considering the embodiment of FIGS. 1 and 2, a single flap would effectively replace both panel 50 and the lace 54 and would be attached directly to area 42 of the upper at its inner end.

The fastening means may also be changed. In the described embodiment, reference is made to VELCRO (TM) fabrics but it will of course be understood that other equivalent fabrics may be used. Alternatively, press stud fasteners could be employed although press stud fasteners would probably be less desirable in the sense that it would be necessary to carefully position the male and female of such a fastener with respect to one another and to press the elements together quite firmly in order to fasten the closure. Also, it would be necessary to distribute the elements of the fastener on the opposed surfaces of the flap means and upper so that the flap means could be positioned in any of several of a multiplicity of positions so as to provide for the required adjustability of the position of the flap means.

Finally, it should be noted that although the preceding description refers primarily to athletic shoes and running shoes the invention is not restricted to shoes of this type.

I claim:

1. A footwear article comprising: a sole; an upper which defines a space above the sole for receiving a wearer's foot, the upper including an ankle opening and an access opening which extends from the ankle opening towards the toe area of the article and which is arranged to permit portions of the upper adjacent said access opening to be raised to facilitate movement of a wearer's foot into and from said space; and a closure for said access opening, said closure comprising flexible flap means having a first portion secured to the upper adjacent a first side of said access opening, the flap means across said opening and having a second portion adapted to be releasably secured to the upper adjacent a second side of said access opening, the spacing between the first and second portions being adjustable, releasable and flexible fastening means on said second portion and on the upper for securing the second portion, said second portion of the flap means being a flexible flap member which has part thereof permanently affixed to the upper in a non-pivotal manner, whereby alignment of the flap member on the upper is readily accomplished by laying the flap member against the upper in its natural configuration.

2. An article as claimed in claim 1, in which said first portion of the flap means includes a lace threaded through eyelets in the upper adjacent said first side of the access opening and through eyelets in said flap member.

3. An article as claimed in claim 1, in which the part of the flap member which is permanently affixed to the upper is adjacent the toe end of the access opening.

4. An article as claimed in claim 1, claim 2 or claim 3, in which the access opening extends generally centrally down the instep area of the upper from said ankle opening.

5. An article as claimed in claim 3, in which said first portion of the flap means includes a lace threaded through eyelets in the upper adjacent said first side of the access opening and through eyelets in said flap member.

6. An article as claimed in claim 1, in which said flap means includes a generally U-shaped panel having two arms joined by a base and a central opening between the arms, the opening coinciding with the access opening in the zipper, one arm of the U-shaped panel being stitched to the upper adjacent the access opening, the base of the U-shaped panel including the lower end of the other arm being stitched to the upper adjacent the bottom of the access opening, said flap member being integral with said other arm of the U-shaped panel.

7. An article as claimed in claim 6, in which said releasable fastening means includes co-operable fastening elements on opposed surface portions of said flap member and said upper, said elements being of a first type on one of the surface portions and of a second type on the other surface portion, said element types being adapted to interengage with one another for securing the flap member to the upper and to be separated by pulling apart the flap member and the upper when the closure is to be opened, the fastening elements being distributed over said surface portions so as to permit the flap means to be positioned in any of a plurality of fastening positions.

* * * * *